US007810361B2

(12) United States Patent
Hashimoto

(10) Patent No.: US 7,810,361 B2
(45) Date of Patent: *Oct. 12, 2010

(54) WASHING APPARATUS

(75) Inventor: Hideo Hashimoto, Uji (JP)

(73) Assignee: Happy Co., Ltd., Uji, Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/632,503

(22) Filed: Dec. 7, 2009

(65) Prior Publication Data

US 2010/0077802 A1 Apr. 1, 2010

Related U.S. Application Data

(62) Division of application No. 10/591,171, filed on Aug. 30, 2006, now Pat. No. 7,650,659.

(30) Foreign Application Priority Data

Sep. 28, 2005 (JP) ..... 2005-281052
Mar. 8, 2006 (JP) ..... 2006-062616

(51) Int. Cl.
*D06F 21/04* (2006.01)
*D06F 33/02* (2006.01)
*D06F 37/06* (2006.01)

(52) U.S. Cl. ..... 68/12.05; 68/12.21; 68/24; 68/142

(58) Field of Classification Search ..... 68/24, 68/142, 12.05, 12.21
See application file for complete search history.

(56) References Cited

U.S. PATENT DOCUMENTS 1,641,780 A 9/1927 Parker
1,850,951 A * 3/1932 Allbright ..... 452/123
2,591,143 A 4/1952 Eilersgaard
3,866,731 A 2/1975 Nagel
5,029,458 A * 7/1991 Obata et al. ..... 68/19.2
5,207,764 A * 5/1993 Akabane et al. ..... 68/20
6,502,433 B1 * 1/2003 Uhlin ..... 68/24
6,843,079 B2 * 1/2005 Hird ..... 68/13 R
2001/0027580 A1 * 10/2001 Back et al. ..... 8/158

(Continued)

FOREIGN PATENT DOCUMENTS

EP 1 433 887 A1 6/2004

(Continued)

*Primary Examiner*—Joseph L Perrin
(74) *Attorney, Agent, or Firm*—Global IP Counselors, LLP

(57) ABSTRACT

A washing apparatus includes an outer casing being disposed to contain liquid for washing, a cylindrical basket-like washing tub, a rotating mechanism, a sensor, a controller, and a plurality of slits. The cylindrical basket-like washing tub is disposed in the outer casing and disposed to contain clothing. The plurality of protruding portions are disposed on an inner surface of the cylindrical basket-like washing tub. The plurality of protruding portions protrude in a radial direction and extend along an axial direction. The rotating mechanism is disposed to rotate the cylindrical basket-like washing tub. The sensor is disposed to detect the level of the liquid in the outer casing. The controller is disposed to start rotating the cylindrical basket-like washing tub when the cylindrical basket-like washing tub is confirmed to be full of the liquid. The plurality of slits penetrate through the cylindrical basket-like washing tub.

10 Claims, 6 Drawing Sheets

U.S. PATENT DOCUMENTS

| | | | | |
|---|---|---|---|---|
| 2005/0132755 | A1* | 6/2005 | Sundell et al. | 68/3 R |
| 2005/0257576 | A1* | 11/2005 | Omura et al. | 68/12.05 |

FOREIGN PATENT DOCUMENTS

| | | | |
|---|---|---|---|
| EP | 1 502 982 | A2 | 2/2005 |
| JP | 35-31858 | U | 11/1959 |
| JP | 60-246790 | A | 12/1985 |
| JP | 4-61893 | A | 2/1992 |
| JP | 4-164494 | A | 6/1992 |
| JP | 6-238086 | A | 8/1994 |
| JP | 9-248395 | A | 9/1997 |
| JP | 9-276582 | A | 10/1997 |
| JP | 11-169579 | A | 6/1999 |
| JP | 11-267391 | A | 10/1999 |
| JP | 2001-269495 | A | 10/2001 |
| JP | 2002-58892 | A | 2/2002 |
| JP | 2003-260290 | A | 9/2003 |

* cited by examiner

WASHING APPARATUS

The present application is a Divisional of U.S. patent application Ser. No. 10/591,171, filed on Aug. 30, 2006, now U.S. Pat. No. 7,650,659 and for which claims the priority benefits of JP 2005-73478, filed on Mar. 15, 2005, JP 2005-281052 filed on Sep. 28, 2005 and JP 2006-062616 filed on Mar. 8, 2006, the entire contents of these applications are herein fully incorporated by reference.

TECHNICAL FIELD

This invention relates to a method for washing clothes and the like.

BACKGROUND ART

As a method of washing clothes made from wool, for example, a washing method called dry cleaning has widely been known. The dry cleaning is a method of cleaning clothes using a petroleum solvent or an organic solvent as a cleaning liquid. The dry cleaning is the washing method capable of preventing loss of shape, shrinkage, swelling, and the like of the clothes while washing clothes conveniently. This is one of reasons of the widespread of the dry cleaning.

More specifically, contaminations adhered to clothes are usually of water-soluble contaminations such as sweat, foods, and mud. In order to perfectly clean such water-soluble contaminations, it is necessary to wash the clothes with water. However, when the clothes made from wool are washed with water, a scale formed on a surface of fibers (wool) is damaged to change a fabric to a felt-like one. When the fabric becomes feltish, the clothes are hardened to loose the original texture and to be difficult to wear. However, when the petroleum solvent or the like is used as the cleaning liquid, the above-described fabric change does not occur. Therefore, the dry cleaning has widely been employed as the clothes washing method.

However, in the case where the petroleum solvent is used as the cleaning liquid, the water soluble contaminations adhered to the clothes are not cleaned perfectly, and yellowing and the like of the clothes can occur later on. That is, the dry cleaning is employed for the purpose of avoiding the risk of damage on clothes though it is necessary to wash the clothes with water in order to perfectly clean the contaminations of the clothes.

The washing method employed for conventional washing machines can be divided into two types. One of them is a washing method utilizing a rotating current of a washing liquid (see, for example, Patent Publication 1), and the other is a washing method utilizing a mechanical force (see, for example, Patent Publications 2 and 3).

With the washing method utilizing the rotating current of cleaning liquid, a washing tub is rotated about a rotation shaft disposed in a substantially vertical direction, so that the cleaning liquid is rotated in a substantially horizontal direction inside the washing tub. Clothes are cleaned by means of the rotating current of cleaning liquid. With the washing method utilizing the mechanical force, a washing tub is rotated about a rotation shaft disposed in a substantially horizontal direction, so that clothes placed in the washing tub are moved upward along an inner wall surface of the washing tub and then fall down. The clothes are cleaned by means of impact caused when the clothes fall on the inner wall surface of the washing tub. That is, with the washing method utilizing the rotating current of cleaning liquid, the contaminations are separated when the clothes are twisted round by means of the rotating cleaning liquid. With the washing method utilizing the mechanical force, the contaminations are separated by means of the impact applied on the clothes. In both washing methods, burden on the fabrics is large, and, though a certain cleaning effect is achieved by the washing methods, the fabrics are steadily damaged.

Conventional washing apparatuses and washing methods are disclosed in Patent Publications 1 to 10 listed below. Particularly, Patent Publication 4 (JP-A-4-61893) discloses a washing method for flipping a laundry article by means of a jet current and a washing apparatus for performing the washing method. As disclosed in Patent Publication 4, the washing apparatus is provided with an outer barrel (1) and an inner barrel (4). The laundry article is placed in the inner barrel (4), and the outer barrel (1) is filled with a washing liquid. A propelling wing (18) is disposed in a space communicated with an interior of the outer barrel (1). When the propelling wing (18) is rotated, a strong swirling current of the washing liquid is generated in the outer barrel (1). The laundry article is twisted round by the swirl of washing liquid, so that the contaminations are cleaned.

As explained above, Patent Publication 4 discloses that the contaminations of the laundry article thrown into the washing liquid filled in the washing tub are cleaned by the strong current of the washing liquid. It is said in Patent Publication 4 that the washing method causes little damage on the laundry article and exhibits a strong detergency (see page 4, fourth line of upper right column to lower left column). However, since the washing method disclosed by Patent Publication 4 utilizes the strong swirl of the washing liquid generated by the propelling wing (18) as explained in the foregoing, the washing method is far from being harmless for the laundry article. More specifically, with the washing method disclosed by Patent Publication 4, a swirling jet current turning around repeatedly in the vertical direction of the inner barrel is generated. This swirling jet current moves the laundry article vertically. The laundry article is cleaned in such a manner that the laundry article is pressed against an inner upper surface and an inner lower surface of the inner barrel to be rubbed and, at the same time, twisted round and then untwisted. With such washing method, the damage on the laundry article is not small at all, and it is apparent that the laundry article is strongly twisted so that the fibers constituting the laundry article are damaged.

Patent Publication 1: JP-A-2002-58892

Patent Publication 2: JP-A-2003-260290

Patent Publication 3: JP-A-2001-269495

Patent Publication 4: JP-A-4-61893

Patent Publication 5: JP-A-4-164494

Patent Publication 6: JP-A-11-169579

Patent Publication 7: JP-A-60-246790

Patent Publication 8: JP-UM-B-35-31858

Patent Publication 9: JP-A-11-267391

Patent Publication 10: JP-A-6-238086

DISCLOSURE OF THE INVENTION

Problems to be Solved by the Invention

This invention has been accomplished in view of the above-described circumstances, and an object thereof is to provide a washing method for reliably cleaning oil-soluble contaminations and water-soluble contaminations such as sweat without damaging a fabric even when the fabric is a delicate one such as wool.

Means for Solving the Problems (1) In order to attain the above object, the washing method of this invention is performed as follows. A cylindrical basket-like washing tub is disposed in an outer casing. A laundry article is placed in the cylindrical basket-like washing tub. Then a cleaning liquid is fed into the outer casing so as to fill the cylindrical basket-like washing tub with the cleaning liquid. After that, the cylindrical basket-like washing tub is rotated about the central shaft for washing the laundry article in the near zero gravity state, namely in such a manner that the laundry article floats in the cleaning liquid and is spread out so as to be increased in contact area with the cleaning liquid in the cylindrical basket-like washing tub.

As used herein, "the near-zero gravity state" does not mean a real zero gravity state in that the weight of a laundry becomes zero but means such a state in which the laundry article floats while being spread out in the cleaning liquid. Therefore, certain gravity is exerted on the laundry article disposed in the cylindrical basket-like washing tub. At the same time, since the cylindrical basket-like washing tub is filled with the cleaning liquid, buoyancy corresponding to a volume of the laundry article and a density of the cleaning liquid is exerted on the laundry article. Accordingly, the laundry article floats inside the cylindrical basket-like washing tub. The cleaning liquid is fed into the outer casing surrounding the cylindrical basket-like washing tub so as to fill the cylindrical basket-like washing tub with the cleaning liquid. Therefore, the laundry article maintains a floating state in the cylindrical basket-like washing tub when the cylindrical basket-like washing tub is rotated.

Since the central shaft of the cylindrical basket-like washing tub is disposed in the horizontal direction, the cylindrical basket-like washing tub functions as a so-called front-loading design tub. When the cylindrical basket-like washing tub is rotated, the laundry article is maintained in a floating state and is spread out in such a manner as to be unfolded in the cylindrical basket-like washing tub. Thus, the contact area of the laundry article with the cleaning liquid is increased, thereby enabling the surfactant contained in the cleaning liquid to permeate deep into fibers of the fabric forming the laundry article. Due to the deep permeation of the surfactant to the fibers of fabric forming the laundry article, contaminations adhered to the fibers are easily removed without the aid of physical external force. That is, the contaminations adhered to fibers are removed easily without the application of mechanical external force to the laundry article and the pounding and twisting of the laundry article by water-current jet.

(2) A wavy patterned surface may preferably be formed on an inner periphery of the cylindrical basket-like washing tub along a circumferential direction for causing the cleaning liquid to flow toward a center of the cylindrical basket-like washing tub when the cylindrical basket-like washing tub is rotated. The cylindrical basket-like washing tub may preferably have an inner diameter of less than 500 mm and may preferably be rotated for 60 to 120 times per minute. The wavy pattered surface may preferably be in the form of a sine curve having protrusions protruding in a radial direction of the cylindrical basket-like washing tub.

Due to the wavy patterned surface of the inner periphery of the cylindrical basket-like washing tub, the cleaning liquid moves mildly to the center of the cylindrical basket-like washing tub and then moves in the axial direction when the cylindrical basket-like washing tub is set to the above size and rotated at the above speed. The cleaning liquid moving to the center of the cylindrical basket-like washing tub maintains the laundry article at a floating state and causes the laundry article to move away from the inner periphery of the cylindrical basket-like washing tub. Particularly, since the wavy patterned surface is formed on the inner wall surface of the cylindrical basket-like washing tub, a mild current in the form of a swirl generates near an inner wall surface of the cylindrical basket-like washing tub. Due to the swirl, the laundry article is prevented from contacting the inner periphery of the cylindrical basket-like washing tub, and damages on the laundry article are reliably prevented. Further, the cleaning liquid moving in the axial direction from the center of the cylindrical basket-like washing tub spreads out the laundry article in the cylindrical basket-like washing tub. Thus, the cleaning liquid mildly and reliably flows between fibers of the laundry article, and the surfactant contained in the cleaning liquid reliably separates the contaminations adhered to the laundry article from the laundry article.

(3) In the case where the wavy patterned surface is formed on the inner periphery of the cylindrical basket-like washing tub along the circumferential direction for causing the cleaning liquid to flow toward the center of the cylindrical basket-like washing tub when the cylindrical basket-like washing tub is rotated, the cylindrical basket-like washing tub may have an inner diameter of more than or equal to 500 mm and may be rotated for 5 to 60 times per minute. The wavy pattered surface may preferably be in the form of a sine curve having protrusions protruding in the radial direction of the cylindrical basket-like washing tub.

(4) Further, in the case where the cylindrical basket-like washing tub is rotated for 10 or more times per minute, the cylindrical basket-like washing tub may preferably be rotated normally and reversely with regularity.

Due to the normal and reverse rotations, the cleaning liquid is regulated to flow in the predetermined direction without fail in the case where the cylindrical basket-like washing tub is rotated at the high speed of 10 or more times per minute. By appropriately setting a cycle of the normal and reverse rotations, the cylindrical basket-like washing tub rotates in a swinging manner like a cradle. Such rotation manner has the advantage that the laundry article is cleaned remarkably softly.

(5) The wavy patterned surface may be formed of protruding parts disposed on the inner periphery of the cylindrical basket-like washing tub parallelly to one another along the circumferential direction at a constant interval, the protruding parts extending in a longitudinal direction of the cylindrical basket-like washing tub. A height of each of the protruding parts may preferably be set to from 3.0% to 6.0% of the inner diameter D of the cylindrical basket-like washing tub.

The protruding parts may be formed integrally with the cylindrical basket-like washing tub. Thus, the wavy patterned surface has an advantage that it is formed simply and at a low cost. Also, by setting the height of the protruding parts within the above range, a swirl-like cleaning liquid current which is considerably mild and capable of reliably keeping the laundry article away from the inner periphery of the cylindrical basket-like washing tub is formed near the inner periphery of the cylindrical basket-like washing tub. Therefore, the contact of the laundry article with the inner periphery of the cylindrical basket-like washing tub is more reliably prevented, and, at the same time, the laundry article is further spread out at the central part of the cylindrical basket-like washing tub.

(6) The cylindrical basket-like washing tub may preferably be rotated intermittently.

With the intermittent rotation of the cylindrical basket-like washing tub, the cleaning liquid current becomes irregular. Therefore, though the cleaning liquid current is mild, the cleaning liquid flows between fibers of the laundry article without fail. Accordingly, the surfactant acts more effectively to reliably separate the contaminations adhered to the laundry article from the laundry article.

(7) The cleaning liquid in the cylindrical basket-like washing tub may preferably be increased or decreased in pressure by a pressure change device.

By the change in pressure of the cleaning liquid, the cleaning liquid permeates deep into the fibers constituting the laundry article. Also, since the air contained in the fibers is removed by the change in pressure of the cleaning liquid, the cleaning liquid reliably permeates deep into the fibers. Further, since the cylindrical basket-like washing tub is filled with the cleaning liquid, a strong swirl or the like does not occur by the change in pressure of the cleaning liquid. Therefore, the laundry article is not damaged by the pressure change of the cleaning liquid.

That is, contaminations adhered to surfaces of the fibers as well as contaminations permeated deep into the fibers (deposited contaminations) are removed without fail. Particularly, though the contaminations permeated deep into the fibers become the cause of yellowing of the fabric when they are oxidized, the yellowing of fabrics is prevented without fail since such contaminations are removed without fail.

Effect of the Invention

According to this invention, since the surfactant permeates deep into fibers of a fabric constituting a laundry article, contaminations adhered to the laundry article is easily removed without applying a physical external force to the laundry article. Therefore, water soluble contaminations adhered to the fabric, such as sweat and mud, are reliably removed without loosing a texture of the fabric even when the laundry article is made from wool, for example, which is easily damaged. As a result, the following effects are achieved.

(1) It is possible to use water and an emulsified liquid in addition to an organic solvent and a petroleum solvent as a cleaning liquid. The use of the organic solvent is of course possible in this invention; however, it is possible to realize a remarkably environment-friendly commercial laundry method by refraining from using the organic and petroleum solvents.

(2) Since shrinkage and texture loss of fabric are prevented, even in the case of washing a clothing item constituted of a plurality of types of fabrics (typically a lounge suit formed of an outer material made of wool, an interlining cloth made from cotton, and a lining cloth made from rayon), creases due to differences in shrinkage factor of the fabrics do not occur in the clothing item. In the commercial laundry, it is generally difficult to remove the creases caused by shrinkage factor differences of fabrics, particularly creases caused by shrinkage of a sewing thread, through correction of such shrinkage, and, therefore, a high cost is incurred for a finishing work (press finishing). However, since the creases due to shrinkage factor differences are prevented according to this invention, this invention enables easier press finishing in the commercial laundry to reduce the cost of cleaning service. For instance, with the washing method of this invention, it is possible to perform washing at a cost which is 1/10 of the conventional water washing.

(3) Further, since the contaminations are removed due to the action of surfactant as described above, it is possible to suppress damages on fabric as compared to hand washing. Therefore, this invention enables secure washing of expensive underwear or the like made from a remarkably delicate fabric.

BEST MODE FOR CARRYING OUT THE INVENTION

Hereinafter, this invention will be described in detail with reference to the drawings and based on preferred embodiments.

FIG. 1 is a schematic diagram showing a washing apparatus for implementing a washing method according to one embodiment of this invention.

The washing apparatus 10 is provided with a washing tub unit 11, a support device 12 for supporting the washing tub unit 11, a rotation drive device 13 for rotating the washing tub unit 11 in the manner described later in this specification, a cleaning liquid supply device 14 for supplying a cleaning liquid to the washing tub unit 11 and forcibly generating a mild current of the cleaning liquid in the washing tub unit 11, and a pressure change device 16 for changing an inside pressure of the washing tub unit 11. Though not shown in FIG. 1, the washing apparatus 10 is provided with a control device for controlling operations of the rotation drive device 13, the cleaning liquid supply device 14, and the pressure change device 16. Constitution of the control device will be described later in this specification.

The washing tub unit 11 is provided with a casing (outer casing) 17 and a frame body (cylindrical basket-like washing tub) 18. The frame body 18 is disposed inside the casing 17 and enclosed by the casing 17. The casing 17 may be made from a metal such as a stainless steel and an aluminum alloy. The casing 17 is provided with a door 20 disposed at its front face as shown in FIG. 1. The door 20 is provided with a handle 15. A user of the washing apparatus 10 operates the handle 15 to open/close the door 20. The front face of the casing 17 is opened/closed in a liquid tight fashion by the door 20. After the door 20 is closed, a cleaning liquid is supplied as described later in this specification. Thus, the casing 17 is filled with the cleaning liquid.

The casing 17 has the shape of a cylindrical container as shown in FIG. 1. Of course, the casing 17 may have a different shape. In short, it is sufficient that the casing 17 has the shape capable of being filled with the cleaning liquid, and housing the frame body 18. The door 20 of the casing 17 may be provided with a window for watching the inside of the casing 17. A transparent acryl plate or the like may preferably be fitted to the window. The provision of such window makes it possible to watch a washing state from the outside.

The support device 12 is attached to the casing 17. The support device 12 stably supports the casing 17. The support device 12 is made from a metal such as a stainless steel and aluminum, too. The casing 17 is disposed in such a fashion that a central axis N thereof is horizontal as being supported by the support device 12. The central axis N coincides with a central axis of the washing tub unit 11 and a central axis of the frame body 18.

FIG. 2 is a perspective view showing the frame body 18. FIG. 3 is a sectional view showing the frame body 18, and FIG. 4 is an enlarged view showing a major part of FIG. 3.

The frame body 18 has a cylindrical shape. The frame body 18 is disposed inside the casing 17 (see FIG. 1). That is, the frame body 18 is fitted into the casing 17 in a nested fashion. Interior part of the frame body 18 is used as a laundry article housing chamber for housing laundry articles. The frame body 18 has a basket-like shape. More specifically, a plurality of slits 37 are provided on a periphery 36 of the frame body 18. Each of the slits 37 penetrates through the periphery 36 of the frame body 18 in a radial direction. Therefore, the cleaning liquid supplied to the casing 17 is allowed to freely move into and out of the frame body 18. The slits 37 extend in an axial direction of the frame body 18 as shown in FIG. 2. The number of the slits 37, a width, and a length of the slits 37 are set appropriately.

A multiple of punching holes may be provided on the frame body 18 in place of the slits 37. The frame body 18 may have a skeleton structure. In short, it is sufficient that the frame body 18 has the basket-like shape which allows the cleaning liquid to freely move into and out of the frame body 18.

The frame body 18 is provided with a central shaft 19. The central shaft 19 is projected from a rear end face 38 (see FIG. 2) of the frame body 18. As described in the foregoing, the center of the central shaft 19 coincides with the central axis N (see FIG. 1). That is, the frame body 18 is disposed in the casing 17 coaxially with the casing 17. As shown in FIG. 1, the central shaft 19 of the frame body 18 is supported by a bearing (not shown). Thus, the frame body 18 rotates about the central axis N freely inside the casing 17. The central shaft 19 is connected to a drive motor 23 described later in this specification. In this embodiment, the central shaft 19 is so supported by the bearing as to support the frame body 18 in a cantilever fashion. Note that the central shaft 19 may be provided on a door 15 of the casing 17 so that the frame body 18 is supported at opposite ends thereof.

As shown in FIGS. 2 to 4, an inner periphery (wavy patterned surface) 39 of the frame body 18 has the shape of a wavy patterned surface. The pattern is formed by forming a plurality of protruding parts 40 on the inner periphery 39 of the frame body 18. The protruding parts 40 extend along an axial direction of the frame body 18. In this embodiment, the multiple of protruding parts 40 are provided on the inner periphery 39 along a circumferential direction of the inner periphery 39 and at a constant interval.

Examples of position of the slits 37 and the shape of the inner periphery 39 are shown in FIG. 3. More specifically, the slits 37 are provided at 6 parts in this embodiment, and the width (length of the frame body 18 in the circumferential direction) of each of the slits 37 is decided by an angle $\alpha$ based on the center of the frame body 18. In this embodiment, the angle $\alpha$ is 8.80 degrees. A distance (length of the frame body 18 in the circumferential direction) between adjacent slits 37 is decided by angles $\beta$ and $\gamma$ based on the center of the frame body 18. In this embodiment, the angle $\beta$ is set to 55.16 degrees, and the angle $\gamma$ is set to 31.29 degrees.

The wavy shape formed by surfaces of the protruding parts 40 may be formed with a sine curve extending along the circumferential direction of the inner periphery 39. Further, successive half-round surfaces may be formed for achieving the wavy shape. In this embodiment, a pitch p of the protruding parts is set to a predetermined proportion with respect to an inner diameter D of the frame body 18. In the example of FIG. 4, the pitch p is set to from 5.0% to 15.0% of the inner diameter D. The pitch p may preferably be set to from 7% to 12% of the inner diameter D. The height h of the protruding parts 40 is set to a predetermined proportion with respect to the inner diameter D of the frame body 18. In the example of FIG. 4, the height may be set to from 3.0% to 6.0% of the inner diameter D. In this embodiment, the inner diameter D of the frame body 18 is set to more than 300 mm to less than 500 mm. The inner diameter D can be modified when so required.

As shown in FIGS. 1 and 2, the rotation drive device 13 has the drive motor 23. The drive motor 23 is mounted on an end face 21 of the casing 17. A driving shaft 24 of the drive motor 23 is coupled to the central shaft 19 of the frame body 18. Therefore, the frame body 18 is rotated about the central axis N in the casing 17 when the drive motor 23 is activated. The frame body 18 rotates normally (in one direction) inside the casing 17 when the drive motor 23 rotates normally, and the frame body 18 rotates reversely (in the other direction) inside the casing 17 when the drive motor 23 rotates reversely. For example in an embodiment, the frame body 18 is designed to be rotated at the speed more than 60 rotations per minute and less than 120 rotations per minute. The rotation speed of the frame body 18 may be optionally designed.

As shown in FIG. 1, the washing liquid supply device 14 is provided with a tank 25 for storing cleaning liquid, an induction pipe 26 connected to the tank 25, a pump 27 to which the induction pipe 26 is connected, a supply pipe 28 connected to the pump 27, a drain pipe 29 connected to the casing 17, and a bypass pipe 30 providing connection between the drain pipe 29 and the induction pipe 26. A pipe made from a stainless steel which is generally used is used as each of the pipes 26, 28, 29, and 30. The induction pipe 26, the drain pipe 29, and the bypass pipe 30 are provided with valves 31 to 33 for opening/closing the pipes. The pump 27 pumps the cleaning liquid filled in the tank 25 to supply the cleaning liquid to the casing 17 and circulates the cleaning liquid as described later in this specification. As the cleaning liquid, water or an emulsified liquid may be used. The cleaning liquid may include a surfactant. In addition, a petroleum solvent and an organic solvent may be used.

The cleaning liquid is temporarily withdrawn from the casing 17 when the cleaning liquid supply device 14 circulates the cleaning liquid filled in the casing 17 as described later in this specification. The withdrawn cleaning liquid is directly returned to the casing 17 with a predetermined pressure. Therefore, a current of the cleaning liquid is generated in the casing 17. In the case where the current is strong, a swirl of the cleaning liquid in the casing 17 can be generated. However, the current of cleaning liquid in this embodiment is so mild as to prevent fabrics of clothes from being damaged even if the swirl is generated by the current of cleaning liquid. Further, as described later in this specification, the cleaning liquid current forcibly positions the laundry articles at a central part of the casing 17. The cleaning liquid may be discharged from the casing 17 during its supply to the casing 17 in addition to the circulation in the casing 17 described above.

The pressure change device 16 is a cylinder piston device in this embodiment. The cylinder piston device is connected to the casing 17. Therefore, the inside pressure of the washing tub unit 11, i.e. the inside pressure of the casing 17, is changed when the piston is activated. The pressure change device 16 is not limited to the cylinder piston device, and any device may be used insofar as the device changes the pressure inside the casing 17 (pressure of the cleaning liquid).

FIG. 5 is a schematic diagram showing a constitution of the control device.

The control device 50 controls operations of the drive motor 23 of the rotation drive device 13, the pump 27 and the valves 31 to 33 of the cleaning liquid supply device 14, and the pressure change device 16 and the like. Therefore, a liquid level sensor 75 is provided in the casing 17, and a rotary encoder 76, a rotation speed sensor 77, and the like are provided in the frame body 18. The liquid level sensor 75 detects an amount of the cleaning liquid in the casing 17. The rotary encoder 76 detects a rotation angle of the frame body 18, and the rotation speed sensor 77 detects a rotation speed of the frame body 18.

The control device 50 is a microcomputer constituted mainly of a CPU (Central Processing Unit) 51, a ROM (Read Only Memory) 52, a RAM (Random Access Memory) 53, and an EEPROM (Electrically Erasable and Programmable ROM) 54. The control device 50 is connected to an ASIC (Application Specific Integrated Circuit) 70 via a bus 69.

The ROM 52 stores a computer program and the like for controlling various operations of the washing apparatus 10. The RAM 54 is used as a storage region or a work region for temporarily storing various data to be used for execution of the program by the CPU 51. The EEPROM 68 stores settings and flags to be retained after the power is turned off.

The ASIC 70 generates signals and the like to be communicated to the drive motor 23 in accordance with instructions from the CPU 51. The signals are sent to a drive circuit 78 of the drive motor 23, and drive signals are communicated to the drive motor 23 via the drive circuit 78. Rotation of the drive motor 23 is controlled as described above, and, as a result, the rotation of the frame body 18 is controlled. The drive circuit 78 is used for driving the drive motor 23 and generates electric signals for rotating the drive motor 23 upon reception of output signals from the ASIC 70. The drive motor 23 rotates upon reception of the electric signals.

The ASIC 70 generates signals and the like to be communicated to the pump 27 in accordance with instructions from the CPU 51. The signals are applied to a drive circuit 79 of the pump 27, and drive signals are communicated to the pump 27 via the drive circuit 79. Rotation of the pump 27 is controlled as described above, and, as a result, supply of the cleaning liquid to the casing 17 is controlled. The drive circuit 79 is used for driving the pump 27 and generates electric signals for rotating the pump 27 upon reception of output signals from the ASIC 70. The pump 27 rotates upon reception of the electric signals.

The ASIC 70 generates signals and the like for driving the pressure change device 16 in accordance with instructions from the CPU 51. The signals are sent to a drive circuit 80 of the pressure change device 16, and drive signals are sent to the pressure change device 16 via the drive circuit 80. The pressure change device 16 is controlled as described above, and, as a result, the pressure of the cleaning liquid in the casing 17 is controlled. The drive circuit 80 is used for driving the pressure change device 16 and generates electric signals for activating pressure change device 16 upon reception of output signals from the ASIC 70. The pressure change device 16 is activated upon reception of the electric signals.

The ASIC 70 generates signals and the like to be communicated to the valves 31 to 33 in accordance with instructions from the CPU 65. The signals are applied to drive circuits 81 to 83 of the valves 31 to 33, and drive signals are communicated to the valves 31 to 33 via the drive circuits 81 to 83. Open/close of the valves 31 to 33 are controlled as described above, and, as a result, supply/discharge of the cleaning liquid to/from the casing 17 are controlled. The drive circuits 81 to 83 are used for driving the valves 31 to 33 and generate electric signals for opening/closing the valves 31 to 33 upon reception of output signals from the ASIC 70. The valves 31 to 33 open/close upon reception of the electric signals.

FIG. 6 is a diagram schematically showing a procedure of washing by the washing apparatus 10. The washing apparatus 10 performs washing of clothes in the following procedure.

As shown in FIG. 5(*a*), clothes (laundry articles) 35 are placed in the washing tub unit 11. More specifically, the door 20 (see FIG. 1) provided on the casing 17 is opened so that the clothes 35 are thrown into the inside of the frame body 18. The work of placing the clothes 35 in the washing tub unit 11 may be performed automatically by a laundry article conveying device (not shown) or the like. In such case, the control device 50 controls operation of the laundry article conveying device. The valves 31 to 33 are closed when the clothes 35 are placed in the washing tub unit 11. A preparation of a cleaning liquid may be performed in the tank 25 simultaneously with the work of placing the clothes 35. Though it is possible to use water as the cleaning liquid in addition to the organic solvent and the petroleum solvent as described in the foregoing, water and a detergent are mixed as the cleaning liquid in this embodiment. Of course, water may be used as the cleaning liquid as it is.

As shown in FIG. 5(*b*), the washing tub unit 11 is filled with the cleaning liquid. The cleaning liquid supply device 14 is activated to supply the cleaning liquid to the washing tub unit 11. More specifically, the valve 31 is opened simultaneously with closure of the valves 32 and 33, and then the pump 27 is activated. With such operations, the cleaning liquid is pumped up from the tank 25 to be supplied to the casing 17 via the induction pipe 26 and the supply pipe 28. The pump 27 supplies the cleaning liquid until the casing 17 is filled with the cleaning liquid. That is, the cleaning liquid is supplied until the casing 17 is filled with the cleaning liquid. In this embodiment, the casing 17 is provided with the liquid level sensor 75 (not shown) (See a schematic diagram in FIG. 5). The liquid level sensor 75 is used for sensing a level of the cleaning liquid supplied to the casing 17. Examples of the liquid level sensor 75 include a sensor which directly detects the level of the cleaning liquid and a pressure sensor which detects a pressure of the cleaning liquid. Since the cleaning liquid is supplied until the casing 17 is filled with the cleaning liquid, it is preferable to use the pressure sensor as the liquid level sensor 75.

The cleaning liquid filled in the casing 17 is tightly sealed. The clothes 35 are disposed in the cleaning liquid tightly sealed in the casing 17. Therefore, a certain gravity is exerted on the clothes 35 in the frame body 18, and buoyancy corresponding to a volume of the clothes 35 and a density of the cleaning liquid are exerted on the clothes 35. Moreover, since the casing 17 is filled with the cleaning liquid, the cleaning liquid fills up the frame body 18. Accordingly, the clothes 35 float inside the frame body 18. Thus, the clothes 35 float in the cleaning liquid, thereby being cleaned softly.

Then, as shown in FIG. 6(*c*), the valves 31 to 33 are closed, followed by start of rotation of the washing tub unit 11. The rotation drive device 13 (see FIG. 1) is activated to rotate the washing tub unit 11 about the central axis N. More specifically, the drive motor 23 of the rotation drive device 13 is activated so that the frame body 18 rotates about the central axis N inside the casing 17. When the frame body 18 is rotated, the cleaning liquid is rotated inside the frame body 18 in a direction of the frame body rotation.

Since the central shaft 19 of the frame body 18 is disposed in the horizontal direction as described in the foregoing, the frame body 18 functions as a so-called front-loading design tub. As shown in FIGS. 2 to 5, the inner periphery 39 of the frame body 18 has the wavy patterned surface. Therefore, the cleaning liquid moves mildly to the center of the frame body 18 and moves along the axial direction from the center of the frame body 18 when the inner diameter D of the frame body 18 is set within the above-described range and the frame body 18 is rotated at the above-described rotation speed.

The cleaning liquid moving to the center of the frame body 18 maintains the clothes in a floating state and moves the clothes 35 away from the inner periphery 39 of the frame body 18. Particularly, since the inner periphery 39 is formed with the wavy patterned surface, a mild current in the form of a swirl generates near the inner wall surface of the frame body 18. This swirl like current prevents contact of the clothes 35 with the inner periphery 39 of the frame body 18. Therefore, fabrics of the clothes 35 are prevented from being damaged during the washing. Further, the cleaning liquid moving along the axial direction from the center of the frame body 18 spreads out each of the clothes 35 inside the frame body 18, thereby increasing a contact area of each of the clothes 35 with the cleaning liquid. Therefore, the surfactant contained in the cleaning liquid permeates deep into fibers of the fabrics constituting the clothes 35. As a result, contaminations adhered to the clothes 35 are easily removed by the action of the surfactant without pounding or twisting of the clothes 35.

When the cleaning of the clothes 35 is finished, the valve 32 is opened at the same time with closure of the valves 31 and 33 as shown in FIG. 6(*d*).

In the washing method according to this embodiment, since the surfactant contained in the cleaning liquid permeates deep into the fibers of the fabrics constituting the clothes 35, the contaminations adhered to the clothes 35 are easily removed without application of physical external forces to the clothes 35. Moreover, the clothes 35 are washed in a floating state in the cleaning liquid. Therefore, even in the case where the clothes are made from delicate fabrics such as wool, the fabrics are not damaged. That is, the contaminations adhered to the fabrics are removed without deteriorating the shapes and the textures of the clothes 35. Accordingly, this invention enables water washing of the clothes made from delicate fabrics such as wool and reliable removal of water-soluble contaminations such as sweat and mud adhered to the clothes. In addition, this invention has advantages that a finishing work becomes easier and creases hardly occur since the clothes 35 are free from the deterioration in shape.

Particularly, in this embodiment, the frame body 18 rotates about the central shaft 19 disposed horizontally. That is, inside the frame body 18, the cleaning liquid rotates about the central axis N. Such constitution has an advantage that the cleaning liquid smoothly passes through the clothes 35. The reason for the advantage is still unclear, but it has been confirmed that more excellent washing is realized by the above-described constitution as compared with a constitution wherein the axial center of the frame body 18 is extended in the vertical direction.

In this embodiment, since the inner periphery 39 of the frame body 18 is formed with the wavy patterned surface, a mild current is formed near the inner periphery 39 of the frame body 18 when the frame body 18 is rotated. Therefore, the clothes 35 are reliably prevented from contacting the frame body 18 and more gently cleaned. Moreover, due to the prevention of the contact of the clothes 35 with the frame body 18, the clothes 35 are always positioned in the vicinity of the center of the frame body 18. Thus, each of the clothes 35 is reliably spread out, and the surfactant acts effectively.

Also, in this embodiment, the wavy patterned surface formed on the inner periphery 39 of the frame body 18 is formed of the protruding parts 40 extending in the axial direction of the frame body 18 and provided along the circumferential direction at a constant interval. More specifically, a wavy and curved thin plate is disposed on the inner surface of the frame body 18. Thus, the wavy patterned surface is formed simply and at a low cost, thereby suppressing an increase in production cost of the washing apparatus 10.

In addition, it is preferable to set the height h of the protruding parts 40 to from 3.0% to 6.0% of the inner diameter D of the frame body 18. Accordingly, the current of cleaning liquid which is remarkably mild and reliably keeps the clothes 35 away from the inner periphery 39 of the frame body 18 is generated near the inner wall surface of the frame body 18. Thus, the contact of the clothes 35 with the inner wall surface of the frame body is more reliably prevented, and each of the clothes 35 is more reliably spread out at the central part of the frame body 18.

The frame body 18 may preferably be rotated intermittently. In order to rotate the frame body 18 intermittently, the rotation of the drive motor 23 is controlled. The rotation control of the drive motor 23 is easily performed by the control device 50. By rotating the frame body 18 intermittently, the current of cleaning liquid in the frame body 18 becomes irregular. Such rotation has the advantage that the cleaning liquid flows between fibers of the clothes 35 without fail though the cleaning liquid current flows mildly.

For instance, a cycle consisting of a rotation of the frame body 18 for 1 to 240 seconds, a halt for 1 to 60 seconds, and a rotation of the frame body 18 for 1 to 240 seconds is repeated. The initial rotation period of the frame body 18 may preferably be from 5 to 200 seconds, more preferably from 10 to 120 seconds, yet more preferably from 20 to 80 seconds. The halt period of the frame body 18 may be set to less than or equal to a second, for example. The rotation period after the halt of the frame body 18 may preferably be from 5 to 200 seconds, more preferably from 10 to 120 seconds, yet more preferably from 20 to 80 seconds. With such rotation cycle, the cleaning liquid more reliably flows between fibers of the clothes 35. Therefore, it is possible to more reliably separate the contaminations adhered to the clothes 35 from the clothes 35 without damaging the clothes 35 by the washing. Of course, the initial rotation period of the frame body 18 and the rotation period after the halt of the frame body 18 may be different from each other.

Also, the frame body 18 may be rotated normally and reversely with regularity. More specifically, the drive motor 23 is rotated normally and reversely with regularity. Such rotation control of the drive motor 23 is easily performed by the control device 50. With such rotation control, the cleansing liquid flows more reliably between fibers of the clothes 35.

For instance, the frame body 18 may be rotated clockwise (in one direction) for 1 to 540 seconds, followed by a halt for 1 to 60 seconds, and then rotated anticlockwise (in the other direction) for 1 to 540 seconds. The clockwise rotation period of the frame body 18 may preferably be from 5 to 440 seconds, more preferably from 10 to 280 seconds, yet more preferably from 20 to 180 seconds. The halt period of the frame body 18 after the clockwise rotation may be set to less than or equal to a second, for example. The anticlockwise rotation period of the frame body 18 after the halt may preferably be from 5 to 440 seconds, more preferably from 10 to 280 seconds, yet more preferably from 20 to 180 seconds. The normal rotation and the reverse rotation are set as one cycle, and this rotation cycle is repeated. Since the frame body 18 is rotated normally and reversely, the cleaning liquid more reliably flows between fibers of the clothes 35. Therefore, it is possible to more reliably separate the contaminations adhered to the clothes 35 from the clothes 35 without damaging the clothes 35 by the washing.

Though the normal rotation is set to the clockwise rotation and the reverse rotation is set to the anticlockwise rotation in the above description, the clockwise and anticlockwise rotations may of course be replaced with each other. Also, the normal rotation period and the reverse rotation period may of course be different from each other.

In this embodiment, the cleaning liquid in the casing 17, i.e. the cleaning liquid in the frame body 18, is increased or decreased in pressure by the pressure change device 16. By the change in pressure of the cleaning liquid, the cleaning liquid permeates deep into the fibers constituting the clothes 35. Further, since the air contained in the fibers is removed by the change in pressure of the cleaning liquid, the cleaning liquid permeates deep into the fibers without fail. Also, since the cleaning liquid is tightly sealed in the frame body 18, the change in pressure of the cleaning liquid does not cause a strong swirl or the like in the frame body 18. Therefore, the clothes 35 are not damaged by the pressure change of the cleaning liquid.

Due to the increase in pressure of the cleaning liquid, the contaminations adhered on surfaces of the fibers as well as contaminations entered deep into the fibers (contaminations deposited on the fibers) are reliably removed without damaging the clothes 35. Particularly, the contaminations entered deep into the fibers can be the cause of yellowing of the fabrics when they are oxidized. However, since such contaminations are reliably removed, this invention has an advantage of reliable prevention of the yellowing of fabrics.

Further, a mild jet current of the cleaning liquid may be formed in the frame body 18 during the cleaning of the clothes 35.

More specifically, the cleaning liquid supply device 14 is activated during the cleaning of the clothes 35. As shown in FIG. 6(*c*), when the valves 31 and 32 are closed at the same time with opening of the valve 33, the pump 27 is activated. Thus, the cleaning liquid is withdrawn from the washing tub unit 11 to be returned to the washing tub unit 11 after passing through the bypass pipe 30 and the supply pipe 28. In this case, a mild current of the cleaning liquid is formed in the washing tub unit 11. Note that it is necessary that the current is considerably weak and does not cause strong twisting of the clothes 35. Such mild current is readily formed by the control of the operation of the pump 27 by the control device 50. The cleaning liquid more smoothly flows between fibers of the clothes 35 due to the cleaning liquid current and the cleaning liquid circulation. As a result, a superior detergency is expected.

The above-described mild current may be formed in the reverse direction. That is, when the valves 31 and 32 are closed at the same time with opening of the valve 33, the pump 27 is activated in the reverse direction. Thus, the cleaning liquid is withdrawn from an upper part of the washing tub unit 11 to be returned to the washing tub unit 11 after passing through the supply pipe 28 and the bypass pipe 30. In this case, a cleaning liquid current oriented upward from the bottom is formed in the washing tub unit 11. Due to such cleaning liquid current, the clothes 35 are reliably positioned at the central part of the washing tub unit 11.

More specifically, the clothes 35 disposed in the washing tub unit 11 are in the above-described floating state. This state is caused by the buoyancy exerted on the clothes 35. Since certain gravity is always exerted on the clothes 35, the clothes 35 tend to sink to the bottom (in a vertically downward direction) of the washing tub unit 11. Due to the cleaning liquid current oriented upward from the bottom in the washing tub unit 11, the clothes 35 are always pushed upward to be positioned at the central part of the washing tub unit 11. Thus, the clothes 35 are reliably prevented from contacting the inner wall surface of the washing tub unit 11, so that the clothes 35 are reliably prevented from being damaged.

In the case where the clothes 35 are moved to the upper part of the washing tub unit 11 due to the cleaning liquid current, the above-described cleaning liquid current oriented downward from the upper part of the washing tub unit 11 is formed to position the clothes 35 at the central part of the washing tub unit 11 again.

In the washing method according to this embodiment, a temperature of the cleaning liquid is not particularly limited. However, the washing apparatus 10 may be provided with a temperature adjustment device for adjusting the temperature of cleaning liquid. The temperature adjustment device may be a heater or the like disposed inside the washing tub unit 11. Outputs from the heater may be controlled by the control device 50. The temperature of cleaning liquid may be set to an optimum value for removing contaminations depending on the type and degree of contaminations. By adjusting the temperature of cleaning liquid, the contaminations adhered to the clothes 35 are removed rapidly and reliably.

Hereinafter, a modification example of this embodiment will be described.

Though the inner diameter D of the frame body 18 of the foregoing embodiment is set to from 300 mm to less than 500 mm, the inner diameter D of this modification example set to 650 mm. Due to the inner diameter D of 650 mm of this modification example, it is possible to sufficiently clean a lounge suit, for example. By the larger inner diameter D of the frame body 18, it is possible to sufficiently clean clothes 35 having large size. Therefore, by setting the inner diameter to from 500 mm to 1,000 mm, the washing method is applicable to commercial laundry. However, with the increase in the inner diameter D, an amount of the cleaning liquid to be supplied to the frame body 18 is increased. Accordingly, the optimum inner diameter for the commercial laundry is from 600 mm to 850 mm and the rotation speed of the frame body 18 is set to 5 to 60 rotations per minute.

In this embodiment, too, the cleaning liquid moves mildly to the center of the frame body 18 and moves in the axial direction from the center of the frame body 18 when the frame body 18 is rotated because the inner periphery 39 of the frame body 18 is in the form of a sine curve and by setting the size and the rotation speed of the frame body 18 within the above ranges. The cleaning liquid moving to the center of the frame body 18 maintains the clothes 35 in a floating state and keeps the clothes away from the inner periphery 39 of the frame body 18. Therefore, as is the case with the foregoing embodiment, contact of the clothes 35 with the inner periphery 39 of the frame body 18 is prevented, so that the clothes 35 are reliably prevented from being damaged. Further, the cleaning liquid moving in the axial direction from the center of the frame body 18 spreads each of the clothes 35 inside the frame body 18. Thus, the surfactant contained in the cleaning liquid reliably flows between fibers of the clothes 35 to separate the contaminations adhered to the clothes 35 though the flow is mild.

In the case where the frame body 18 is rotated at a speed of 10 or more rotations per minute, the frame body 18 may preferably be rotated normally and reversely with regularity. In the case where the frame body 18 is rotated normally and reversely with regularity, the cleaning liquid will not flow strongly in one direction inside the frame body 18 even if the frame body 18 is rotated at the high speed of 10 or more rotations per minute, and a floating state of the clothes 35 in the cleaning liquid is reliably maintained. Also, the frame body 18 may be rotated in a swinging manner like a cradle. It is possible to rotate the frame body 18 in the cradle-swinging manner easily by controlling rotation of the drive motor 23 using the control device 50. Such rotation manner has the advantage that the clothes 35 are cleaned remarkably softly.

EXAMPLES

Effects of this invention will hereinafter be clarified in conjunction with examples; however, this invention should not be interpreted in a limited way based on descriptions of the examples.

In Examples and Comparative Examples, sample pieces (wool) were washed with water. Results of Examples and Comparative Examples are shown in Tables 1 and 2. In Examples and Comparative Examples, the proportion of the height h of the protruding parts 40 (See FIG. 4) to the inner diameter D of the frame body 18 is represented as a drum height ratio (%) (See Tables 1 and 2), and the number of rotations of the frame body 18 means the number of rotations per minute.

In each of Examples and Comparative Examples, a state of the sample pieces during washing and a texture of the sample pieces after washing were observed. The state of the sample pieces during washing was evaluate by way of a degree of impact of the sample pieces on the wall of the frame body 18 and a degree of spreading of each the sample pieces in the frame body 18. The texture of the sample pieces after washing is evaluated by way of a Dp value.

The Dp value means a dimensionless number calculated from a friction coefficient of a surface of each of the sample pieces and a change in friction coefficient in a certain region of the surface of the sample piece. An increase in Dp value means deterioration in texture. A Dp value of the sample pieces before washing was 143. Also, a Dp value of the sample pieces after washing with water by the use of a conventional horizontal washing machine was 185.

Example 1

A drum inner diameter was 340 mm. A drum height ratio was 3%. A rotation direction of the frame body 18 was normal rotation. A rotation period was 60 seconds. A rotation speed of the frame body 18 was changed in the order of 5 rotations per minute, 10 rotations per minute, 60 rotations per minute, and 120 rotations per minute.

Example 2

A drum inner diameter was 340 mm. A drum height ratio was 5%. A rotation direction of the frame body 18 was normal rotation. A rotation period was 60 seconds. A rotation speed of the frame body 18 was changed in the order of 5 rotations per minute, 10 rotations per minute, 60 rotations per minute, and 120 rotations per minute.

Example 3

A drum inner diameter was 340 mm. A drum height ratio was 6%. A rotation direction of the frame body 18 was normal rotation. A rotation period was 60 seconds. A rotation speed of the frame body 18 was changed in the order of 5 rotations per minute, 10 rotations per minute, 60 rotations per minute, and 120 rotations per minute.

Comparative Example 1

A drum inner diameter was 340 mm. A drum height ratio was 0%. A rotation direction of the frame body 18 was normal rotation. A rotation period was 60 seconds. A rotation speed of the frame body 18 was changed in the order of 5 rotations per minute, 10 rotations per minute, 60 rotations per minute, and 120 rotations per minute.

Comparative Example 2

A drum inner diameter was 340 mm. A drum height ratio was 8%. A rotation direction of the frame body 18 was normal rotation. A rotation period was 60 seconds. A rotation speed of the frame body 18 was changed in the order of 5 rotations per minute, 10 rotations per minute, 60 rotations per minute, and 120 rotations per minute.

Comparative Example 3

A drum inner diameter was 340 mm. A drum height ratio was 10%. A rotation direction of the frame body 18 was normal rotation. A rotation period was 60 seconds. A rotation speed of the frame body 18 was changed in the order of 5 rotations per minute, 10 rotations per minute, 60 rotations per minute, and 120 rotations per minute.

Example 4

A drum inner diameter was 340 mm. A drum height ratio was 3%. The frame body 18 was rotated normally and then reversely. A rotation period of the normal rotation was 60 seconds, a halt was one second, and a rotation period of the reverse rotation was 60 seconds. A rotation speed of the frame body 18 was changed in the order of 5 rotations per minute, 10 rotations per minute, 60 rotations per minute, and 120 rotations per minute.

Example 5

A drum inner diameter was 340 mm. A drum height ratio was 5%. The frame body 18 was rotated normally and then reversely. A rotation period of the normal rotation was 60 seconds, a halt was one second, and a rotation period of the reverse rotation was 60 seconds. A rotation speed of the frame body 18 was changed in the order of 5 rotations per minute, 10 rotations per minute, 60 rotations per minute, and 120 rotations per minute.

Example 6

A drum inner diameter was 340 mm. A drum height ratio was 6%. The frame body 18 was rotated normally and then reversely. A rotation period of the normal rotation was 60 seconds, a halt was one second, and a rotation period of the reverse rotation was 60 seconds. A rotation speed of the frame body 18 was changed in the order of 5 rotations per minute, 10 rotations per minute, 60 rotations per minute, and 120 rotations per minute.

Comparative Example 4

A drum inner diameter was 340 mm. A drum height ratio was 0%. The frame body 18 was rotated normally and then reversely. A rotation period of the normal rotation was 60 seconds, a halt was one second, and a rotation period of the reverse rotation was 60 seconds. A rotation speed of the frame body 18 was changed in the order of 5 rotations per minute, 10 rotations per minute, 60 rotations per minute, and 120 rotations per minute.

Comparative Example 5

A drum inner diameter was 340 mm. A drum height ratio was 8%. The frame body 18 was rotated normally and then reversely. A rotation period of the normal rotation was 60 seconds, a halt was one second, and a rotation period of the reverse rotation was 60 seconds. A rotation speed of the frame body 18 was changed in the order of 5 rotations per minute, 10 rotations per minute, 60 rotations per minute, and 120 rotations per minute.

Comparative Example 6

A drum inner diameter was 340 mm. A drum height ratio was 10%. The frame body 18 was rotated normally and then reversely. A rotation period of the normal rotation was 60 seconds, a halt was one second, and a rotation period of the reverse rotation was 60 seconds. A rotation speed of the frame body 18 was changed in the order of 5 rotations per minute, 10 rotations per minute, 60 rotations per minute, and 120 rotations per minute.

Example 7

A drum inner diameter was 650 mm. A drum height ratio was 3%. A rotation direction of the frame body 18 was normal rotation. A rotation period was 60 seconds. A rotation speed of the frame body 18 was changed in the order of 3 rotations per minute, 5 rotations per minute, 10 rotations per minute, 30 rotations per minute, 60 rotations per minute, and 120 rotations per minute.

Example 8

A drum inner diameter was 650 mm. A drum height ratio was 5%. A rotation direction of the frame body 18 was normal rotation. A rotation period was 60 seconds. A rotation speed of the frame body 18 was changed in the order of 3 rotations per minute, 5 rotations per minute, 10 rotations per minute, 30 rotations per minute, 60 rotations per minute, and 120 rotations per minute.

Example 9

A drum inner diameter was 650 mm. A drum height ratio was 6%. A rotation direction of the frame body 18 was normal rotation. A rotation period was 60 seconds. A rotation speed of the frame body 18 was changed in the order of 3 rotations per minute, 5 rotations per minute, 10 rotations per minute, 30 rotations per minute, 60 rotations per minute, and 120 rotations per minute.

Comparative Example 7

A drum inner diameter was 650 mm A drum height ratio was 0%. A rotation direction of the frame body 18 was normal rotation. A rotation period was 60 seconds. A rotation speed of the frame body 18 was changed in the order of 3 rotations per minute, 5 rotations per minute, 10 rotations per minute, 30 rotations per minute, 60 rotations per minute, and 120 rotations per minute.

Comparative Example 8

A drum inner diameter was 650 mm. A drum height ratio was 8%. A rotation direction of the frame body 18 was normal rotation. A rotation period was 60 seconds. A rotation speed of the frame body 18 was changed in the order of 3 rotations per minute, 5 rotations per minute, 10 rotations per minute, 30 rotations per minute, 60 rotations per minute, and 120 rotations per minute.

Comparative Example 9

A drum inner diameter was 650 mm. A drum height ratio was 10%. A rotation direction of the frame body 18 was normal rotation. A rotation period was 60 seconds. A rotation speed of the frame body 18 was changed in the order of 3 rotations per minute, 5 rotations per minute, 10 rotations per minute, 30 rotations per minute, 60 rotations per minute, and 120 rotations per minute.

Example 10

A drum inner diameter was 650 mm. A drum height ratio was 3%. The frame body 18 was rotated normally and then reversely. A rotation period of the normal rotation was 60 seconds, a halt was one second, and a rotation period of the reverse rotation was 60 seconds. A rotation speed of the frame body 18 was changed in the order of 3 rotations per minute, 5 rotations per minute, 10 rotations per minute, 30 rotations per minute, 60 rotations per minute, and 120 rotations per minute.

Example 11

A drum inner diameter was 650 mm. A drum height ratio was 5%. The frame body 18 was rotated normally and then reversely. A rotation period of the normal rotation was 60 seconds, a halt was one second, and a rotation period of the reverse rotation was 60 seconds. A rotation speed of the frame body 18 was changed in the order of 3 rotations per minute, 5 rotations per minute, 10 rotations per minute, 30 rotations per minute, 60 rotations per minute, and 120 rotations per minute.

Example 12

A drum inner diameter was 650 mm. A drum height ratio was 6%. The frame body 18 was rotated normally and then reversely. A rotation period of the normal rotation was 60 seconds, a halt was one second, and a rotation period of the reverse rotation was 60 seconds. A rotation speed of the frame body 18 was changed in the order of 3 rotations per minute, 5 rotations per minute, 10 rotations per minute, 30 rotations per minute, 60 rotations per minute, and 120 rotations per minute.

Comparative Example 10

A drum inner diameter was 650 mm. A drum height ratio was 0%. The frame body 18 was rotated normally and then reversely. A rotation period of the normal rotation was 60 seconds, a halt was one second, and a rotation period of the reverse rotation was 60 seconds. A rotation speed of the frame body 18 was changed in the order of 3 rotations per minute, 5 rotations per minute, 10 rotations per minute, 30 rotations per minute, 60 rotations per minute, and 120 rotations per minute.

Comparative Example 11

A drum inner diameter was 650 mm. A drum height ratio was 8%. The frame body 18 was rotated normally and then reversely. A rotation period of the normal rotation was 60 seconds, a halt was one second, and a rotation period of the reverse rotation was 60 seconds. A rotation speed of the frame body 18 was changed in the order of 3 rotations per minute, 5 rotations per minute, 10 rotations per minute, 30 rotations per minute, 60 rotations per minute, and 120 rotations per minute.

Comparative Example 12

A drum inner diameter was 650 mm. A drum height ratio was 10%. The frame body 18 was rotated normally and then reversely. A rotation period of the normal rotation was 60 seconds, a halt was one second, and a rotation period of the reverse rotation was 60 seconds. A rotation speed of the frame body 18 was changed in the order of 3 rotations per minute, 5 rotations per minute, 10 rotations per minute, 30 rotations per minute, 60 rotations per minute, and 120 rotations per minute.

Contents of Examples 1 to 3 and Comparative Examples 1 to 3 are shown in Table 1. Contents of Examples 4 to 6 and Comparative Examples 4 to 6 are shown in Table 2. Contents of Examples 7 to 9 and Comparative Examples 7 to 9 are shown in Table 3. Contents of Examples 10 to 12 and Comparative Examples 10 to 12 are shown in Table 4.

TABLE 1

(Normal Drum Rotation Only)

| | | Comp. Ex. 1 | Ex. 1 | Ex. 2 | Ex. 3 | Comp. Ex. 2 | Comp. Ex. 3 |
|---|---|---|---|---|---|---|---|
| Drum Height Ratio (%) | | 0 | 3 | 5 | 6 | 8 | 10 |
| Number of Rotations 5 | Degree of Impact and Degree of Spread | Spread wide. Tumbled on the wall slowly. | ← | ← | ← | ← | ← |
| | Texture (Dp) | 145 | 145 | 149 | 149 | 148 | 149 |
| 10 | Degree of Impact and Degree of Spread | Spread wide. Tumbled on the wall and gathered at the center. | ← | ← | ← | ← | ← |
| | Texture (Dp) | 146 | 147 | 150 | 149 | 147 | 149 |
| 60 | Degree of Impact and Degree of Spread | Spread wide. Contacted the wall. | Sufficiently spread at the center. No contact. | Spread near the wall. Tumbled along the wall. | Spread near the wall. Tumbled along the wall. | Contacted with the wall continuously. Gathered tightly. | Pressed against the wall. Gathered tightly. |
| | Texture (Dp) | 150 | 159 | 162 | 174 | 185 | 183 |
| 120 | Degree of Impact and Degree of Spread | Spread wide. Contacted the wall continuously. | Sufficiently spread at the center. No contact. | Spread at the center. No contact. | Tumbled along the wall. No contact. | Pressed against the wall. Gathered tightly. | Pressed against the wall. Gathered tightly. |
| | Texture (Dp) | 150 | 161 | 169 | 173 | 185 | 184 |

TABLE 2

(Normal and Reverse Drum Rotation)

| | | Comp. Ex. 4 | Ex. 4 | Ex. 5 | Ex. 6 | Comp. Ex. 5 | Comp. Ex. 6 |
|---|---|---|---|---|---|---|---|
| Drum Height Ratio (%) | | 0 | 3 | 5 | 6 | 8 | 10 |
| Number of Rotations 5 | Degree of Impact and Degree of Spread | Spread wide. Tumbled on the wall slowly. | ← | ← | ← | ← | ← |
| | Texture (Dp) | 145 | 149 | 150 | 149 | 150 | 149 |
| 10 | Degree of Impact and Degree of Spread | Spread wide. Tumbled on the wall and gathered at the center. | ← | ← | ← | ← | ← |
| | Texture (Dp) | 147 | 151 | 153 | 149 | 151 | 149 |
| 60 | Degree of Impact and Degree of Spread | Spread wide. No contact. | Sufficiently spread at the center. No contact. | Spread near the wall. Tumbled along the wall. | Spread near the wall. Tumbled along the wall. | Pressed against the wall. Gathered tightly. | Pressed against the wall. Gathered tightly. |
| | Texture (Dp) | 155 | 162 | 169 | 177 | 188 | 187 |
| 120 | Degree of Impact and Degree of Spread | Spread wide. Contacted the wall continuously. | Sufficiently spread at the center. No contact. | Spread at the center. No contact. | Tumbled along the wall. No contact. | Pressed against the wall. Gathered tightly. | Pressed against the wall. Gathered tightly. |
| | Texture (Dp) | 156 | 161 | 169 | 178 | 187 | 188 |

TABLE 3

(Normal Drum Rotation Only)

| | | | Comp. Ex. 7 | Ex. 7 | Ex. 8 | Ex. 9 | Comp. Ex. 8 | Comp. Ex. 9 |
|---|---|---|---|---|---|---|---|---|
| Drum Height Ratio (%) | | | 0 | 3 | 5 | 6 | 8 | 10 |
| Number of Rotations | 3 | Degree of Impact and Degree of Spread | Spread wide. Tumbled on the wall slowly. | ← | ← | ← | ← | ← |
| | | Texture (Dp) | 147 | 145 | 146 | 147 | 146 | 147 |
| | 5 | Degree of Impact and Degree of Spread | Spread wide. Contacted the wall. | Spread near the wall. Tumbled along the wall. No contact. | ← | ← | Spread near the wall. Contacted the wall. | ← |
| | | Texture (Dp) | 146 | 146 | 146 | 149 | 157 | 155 |
| | 10 | Degree of Impart and Degree of Spread | Spread wide. Contacted the wall. | Spread wide at the center. No contact. | Spread wide at the center. No contact. | Spread near the wall. Tumbled along the wall. | Contacted the wall continuously and gathered. | Pressed against the wall and gathered. |
| | | Texture (Dp) | 146 | 147 | 148 | 154 | 166 | 171 |
| | 30 | Degree of Impact and Degree of Spread | Spread wide. Contacted the wall. | Spread wide at the center. No contact. | ← | ← | Contacted the wall continuously. Gathered tightly. | Pressed against the wall. Gathered tightly. |
| | | Texture (Dp) | 147 | 151 | 155 | 154 | 177 | 175 |
| | 60 | Degree of Impact and Degree of Spread | Spread wide. Contacted the wall. | Spread wide at the center. No contact. | Spread wide at the center. No contact. | Spread at the center. No contact. | Pressed against the wall. Gathered tightly. | Pressed against the wall. Gathered tightly. |
| | | Texture (Dp) | 146 | 160 | 166 | 165 | 181 | 182 |
| | 120 | Degree of Impact and Degree of Spread | Spread wide. Contacted the wall. | Spread wide. Contacted the wall. | Spread wide. Contacted the wall. | Tumbled along the wall. Contacted the wall. | Pressed against the wall. Gathered tightly. | Pressed against the wall. Gathered tightly. |
| | | Texture (Dp) | 152 | 173 | 175 | 179 | 185 | 184 |

TABLE 4

(Normal and Reverse Drum Rotation)

| | | | Comp. Ex. 10 | Ex. 10 | Ex. 11 | Ex. 12 | Comp. Ex. 11 | Comp. Ex. 12 |
|---|---|---|---|---|---|---|---|---|
| Drum Height Ratio (%) | | | 0 | 3 | 5 | 6 | 8 | 10 |
| Number of Rotations | 3 | Degree of Impact and Degree of Spread | Contacted the wall. Tumbled on the wall slowly. | ← | ← | ← | ← | ← |
| | | Texture (Dp) | 146 | 145 | 146 | 147 | 146 | 147 |
| | 5 | Degree of Impact and Degree of Spread | Spread wide. Tumbled on the wall. | Spread near the wall. Tumbled along the wall. No contact. | ← | ← | Spread near the wall. Contacted the wall. | ← |
| | | Texture (Dp) | 147 | 147 | 146 | 149 | 160 | 158 |
| | 10 | Degree of Impact and Degree of Spread | Spread wide. Tumbled on the wall. | Spread wide at the center. No contact. | Spread wide at the center. No contact. | Spread near the wall. Tumbled along the wall. | Contacted the wall continuously and gathered. | Pressed against the wall and gathered. |
| | | Texture (Dp) | 148 | 146 | 148 | 152 | 174 | 175 |
| | 30 | Degree of Impact and Degree of Spread | Spread wide. Contacted the wall. | Spread wide at the center. No contact. | ← | ← | Contacted the wall continuously. Gathered tightly. | Pressed against the wall. Gathered tightly. |
| | | Texture (Dp) | 148 | 150 | 154 | 154 | 180 | 180 |
| | 60 | Degree of Impact and Degree of | Spread wide. Contacted the wall. | Spread well at the center. No | Spread wide at the center. No | Spread wide at the center. No | Contacted the wall continuously. | Pressed against the wall. |

TABLE 4-continued (Normal and Reverse Drum Rotation)

| | Comp. Ex. 10 | Ex. 10 | Ex. 11 | Ex. 12 | Comp. Ex. 11 | Comp. Ex. 12 |
|---|---|---|---|---|---|---|
| Spread | | contact. | contact. | contact. | Gathered tightly. | Gathered tightly. |
| Texture (Dp) | 146 | 160 | 161 | 163 | 182 | 182 |
| Degree of Impact and Degree of Spread | Spread wide. Contacted the wall. | Spread wide at the center. Contacted the wall. | Spread at the center. Contacted the wall. | Tumbled along the wall. Contacted the wall. | Pressed against the wall. Gathered tightly. | Pressed against the wall. Gathered tightly. |
| Texture (Dp) | 148 | 173 | 176 | 181 | 188 | 187 |

As shown in Tables 1 and 2, when the inner diameter D of the frame body 18 was 340 mm, the sample pieces were washed in the remarkably gentle manner in each of the case where the frame body 18 was normally rotated and the case where the frame body 18 was normally rotated and then reversely rotated insofar as the drum height ratio was set to from 3% to 6% and the rotation speed was set to from 60 to 120 rotations per minute. Note that it was difficult to clean contaminations of the sample pieces when the rotation speed of the frame body 18 was 10 rotations per minute or less and the drum height ratio was 0%.

As shown in Tables 3 and 4, when the inner diameter D of the frame body 18 was 650 mm, the sample pieces were washed in the remarkably gentle manner in each of the case where the frame body 18 was normally rotated and the case where the frame body 18 was normally rotated and then reversely rotated insofar as the drum height ratio was set to from 3% to 6% and the rotation speed was set to from 5 to 60 rotations per minute. Note that it was difficult to clean contaminations of the sample pieces when the rotation speed of the frame body 18 was 5 or less rotations per minute and the drum height ratio was 0%. Also, in Comparative Examples 8, 9, 11, and 12, the texture of the sample pieces was not lost in the case where the rotation speed of the frame body 18 was 10 or less rotations per minute, but the texture can be deteriorated by actual washing since the sample pieces continuously contacted the frame body 18. Further, as is apparent from Tables 3 and 4, in the case of the rotation speed of 10 or more rotations per minute, deterioration in texture of the sample pieces was more reliably prevented when the frame body 18 was rotated normally and reversely.

INDUSTRIAL APPLICABILITY

This invention is applicable to a method for washing clothes and the like.

REFERENCE NUMERALS

Figure 1:
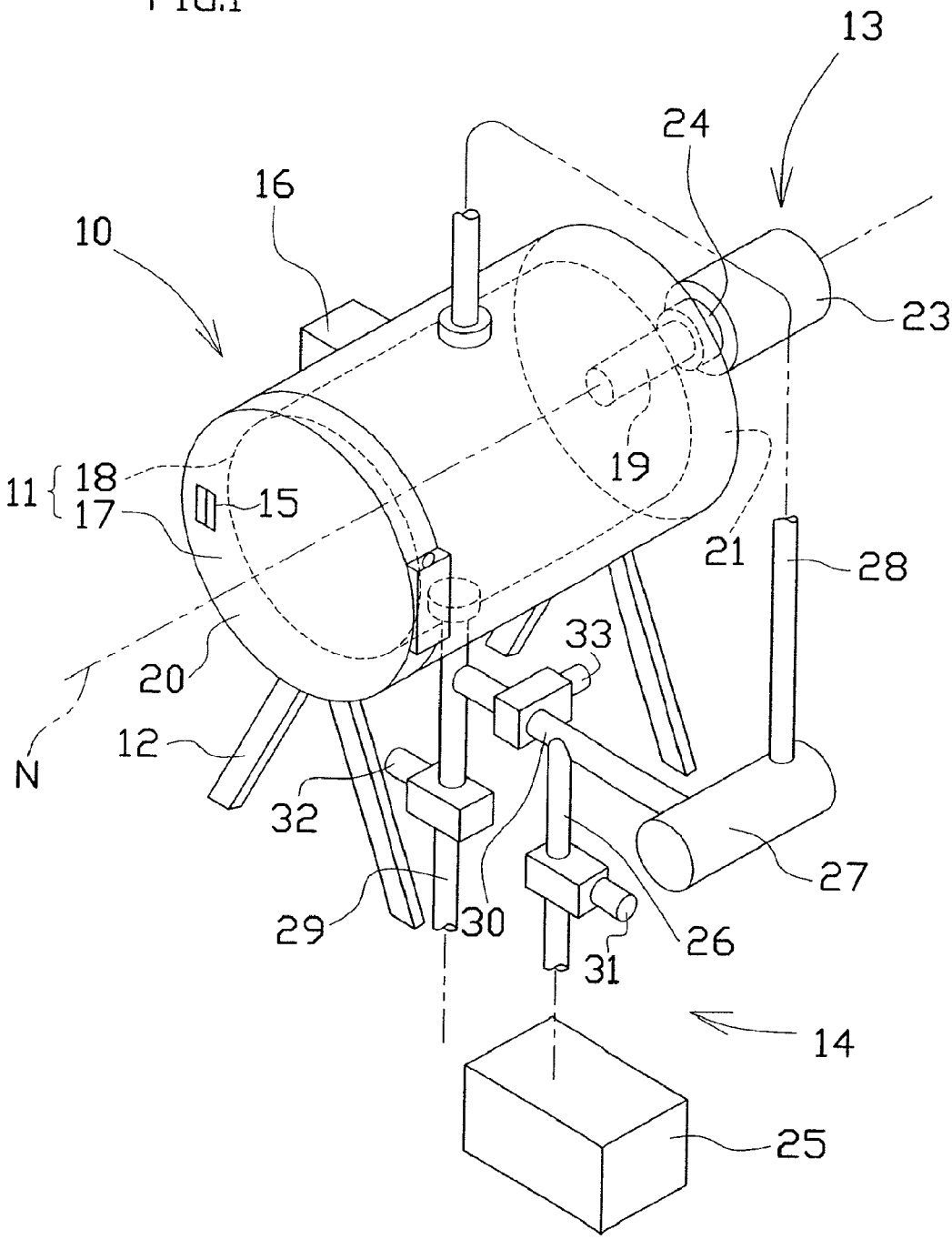
FIG. 1 is a schematic diagram showing a washing apparatus to be used for implementing a washing method according to one embodiment of this invention.
Figure 2:
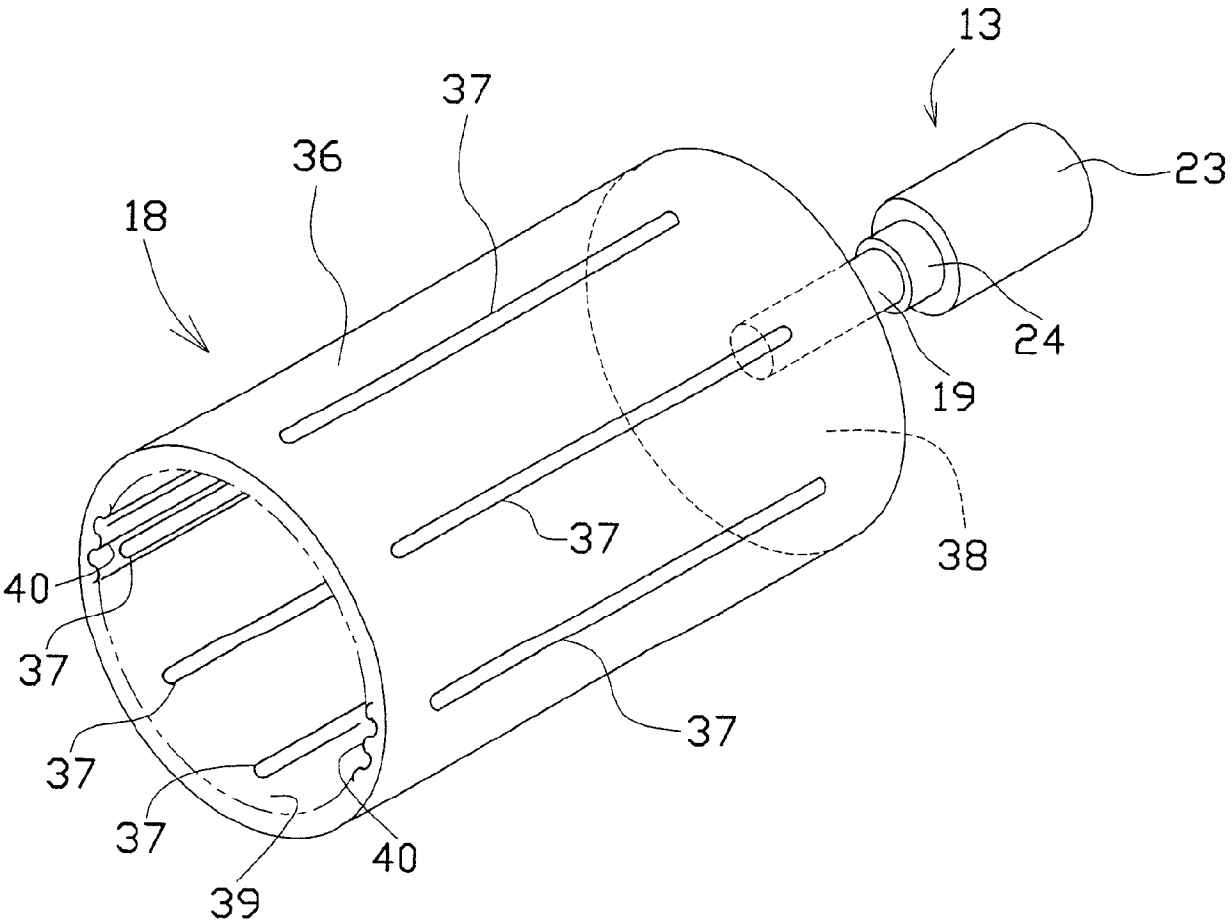
FIG. 2 is a perspective view showing a frame body of a washing apparatus according to the embodiment of this invention.
Figure 3:
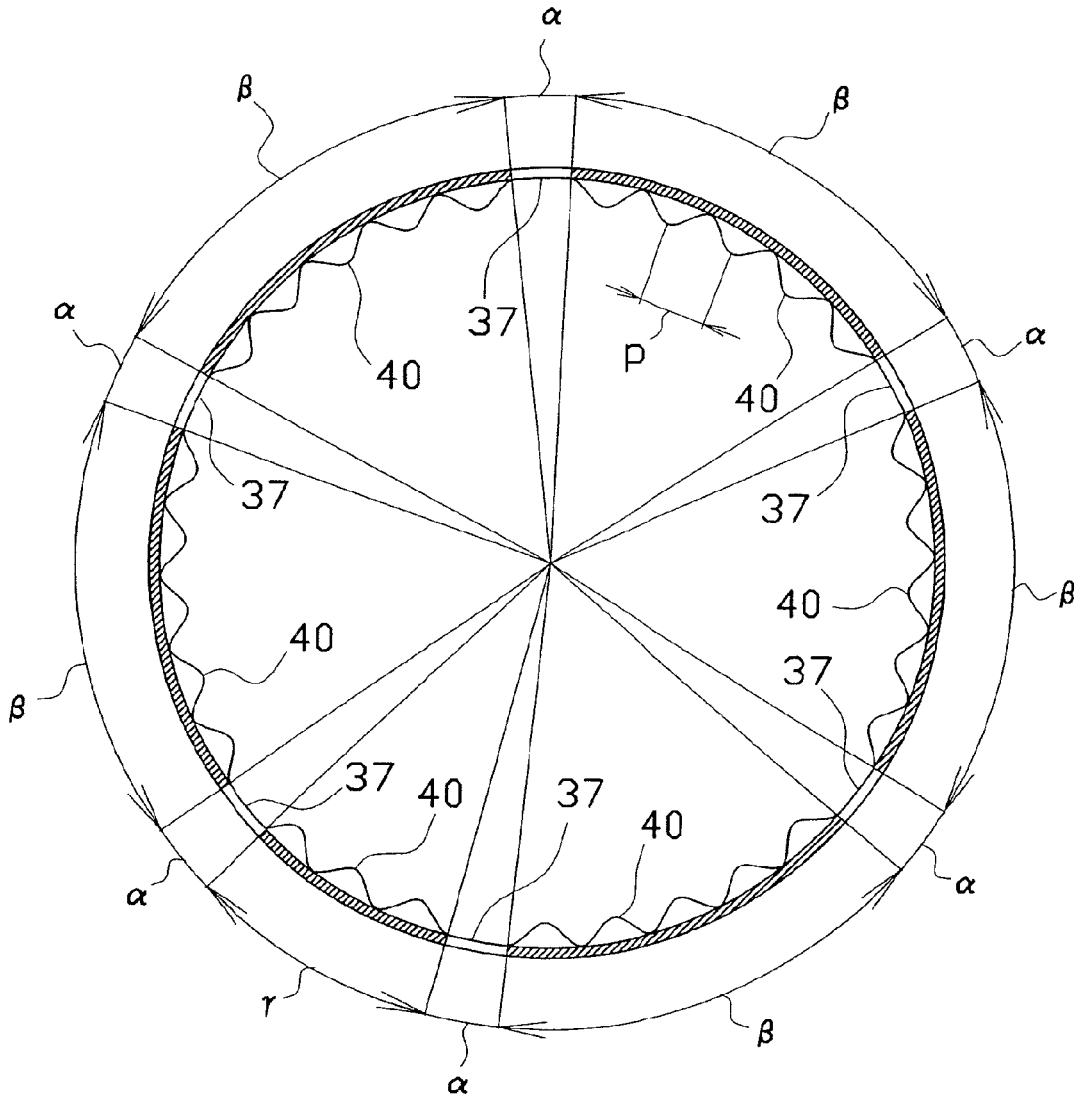
FIG. 3 is a sectional view showing the frame body of the washing apparatus according to the embodiment of this invention.
Figure 4:
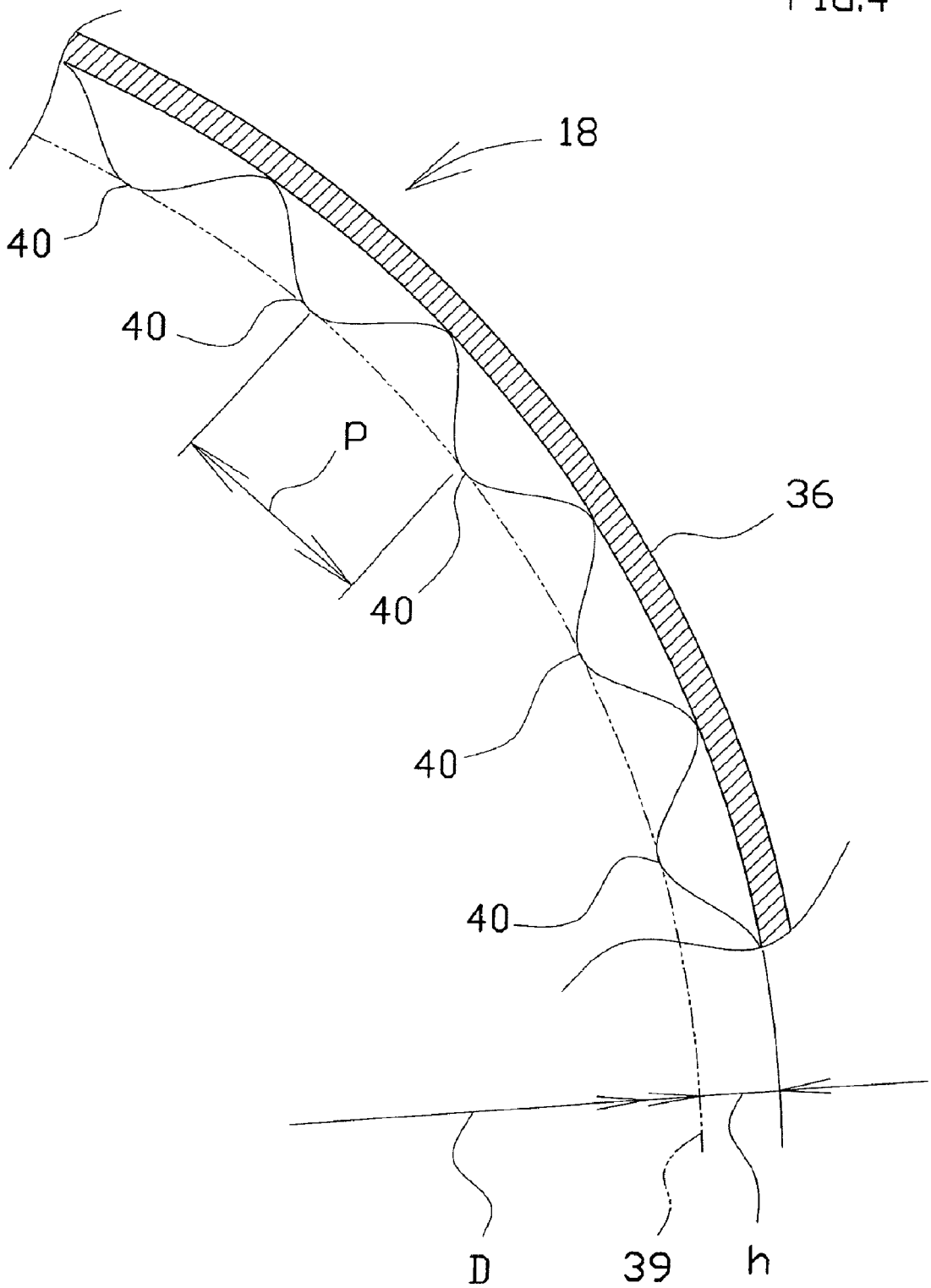
FIG. 4 is an enlarged view showing a major part of FIG. 3.
Figure 5:
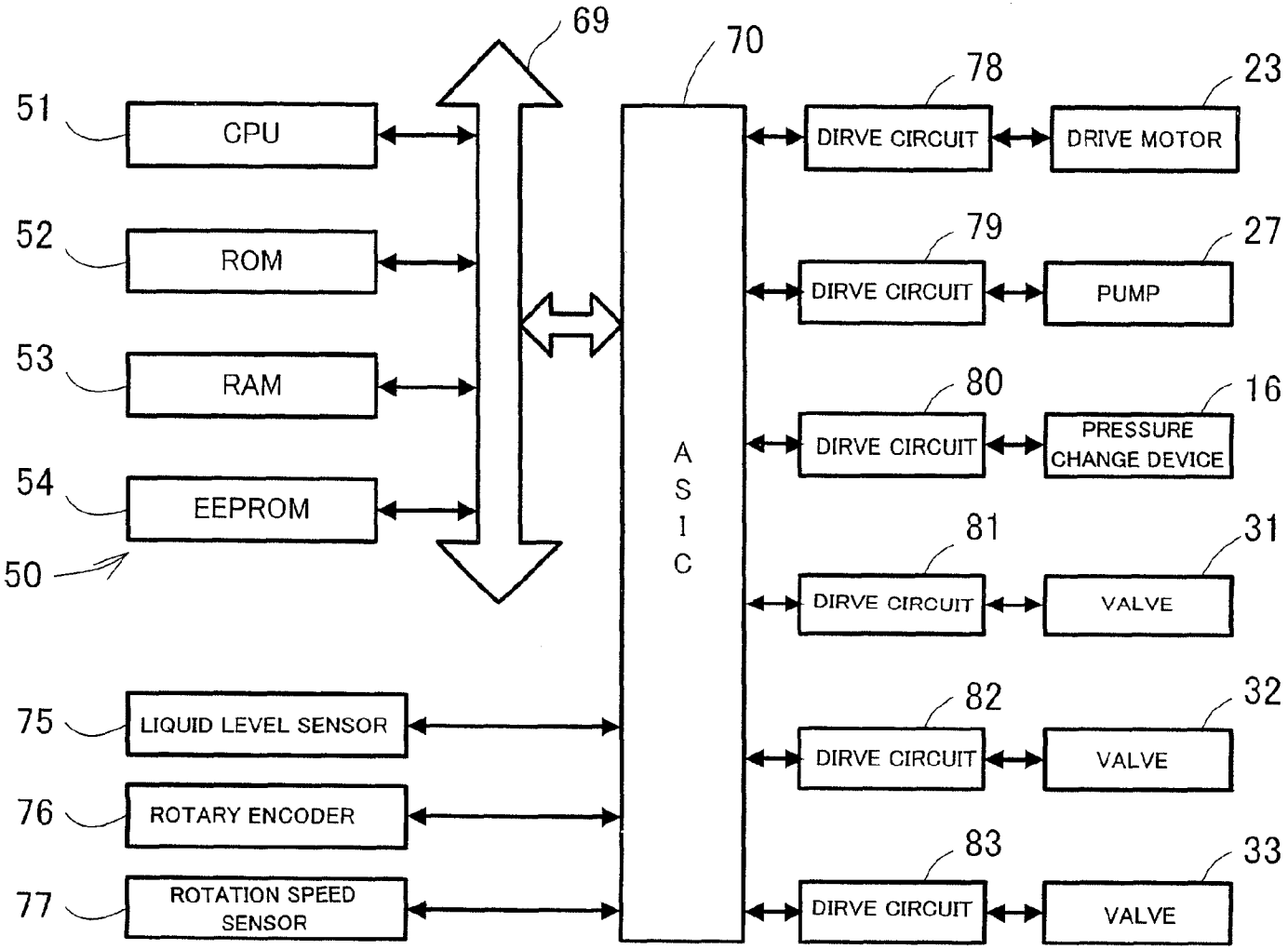
FIG. 5 is a schematic diagram showing a constitution of a control device of the washing apparatus according to the embodiment of this invention.
Figure 6:
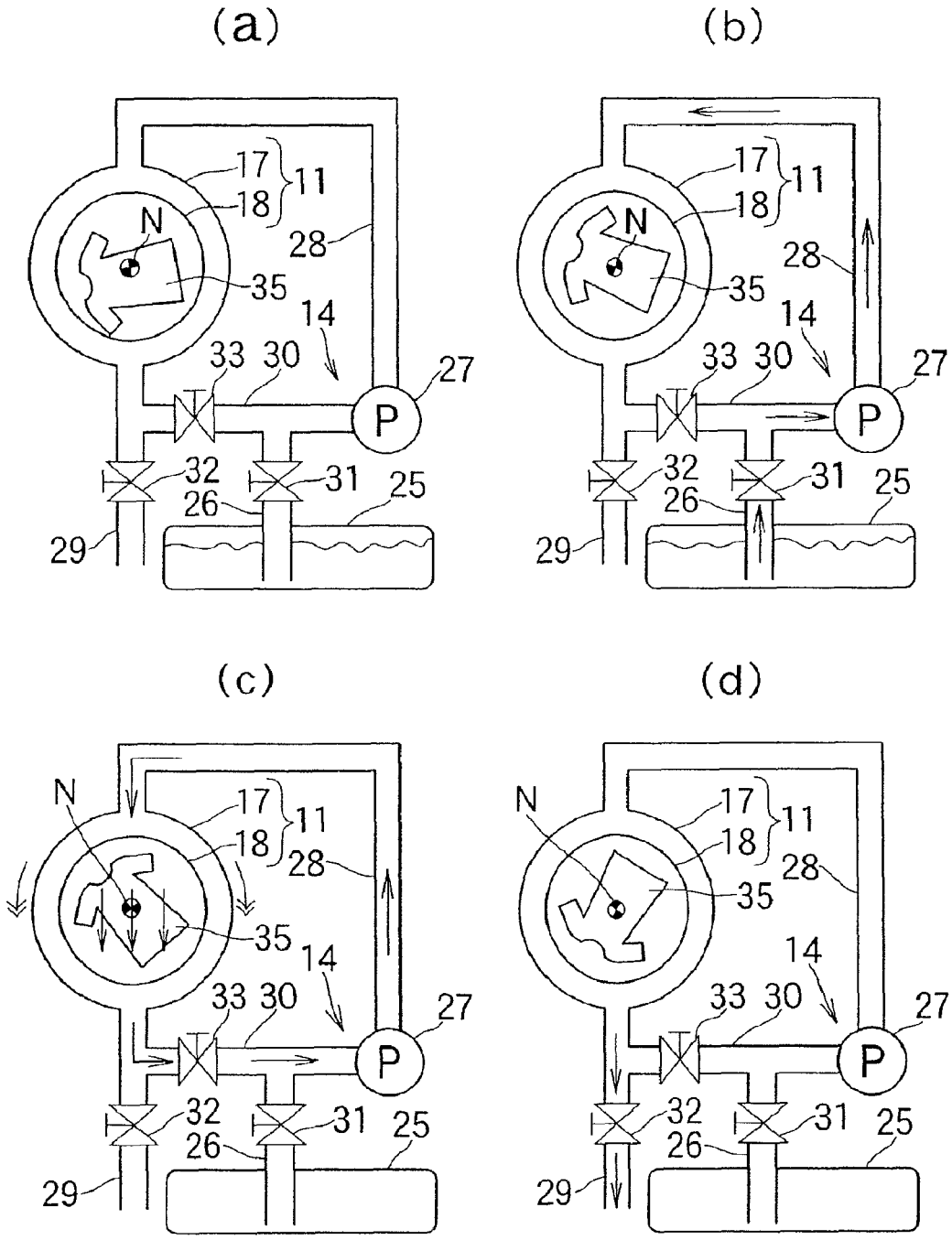
FIG. 6 is a diagram schematically showing a procedure of washing by the washing apparatus according to the embodiment of this invention.

N: center
10: washing apparatus
11: washing tub unit
12: support device
13: rotation drive device
14: cleaning liquid supply device
16: pressure change device
17: casing
18: frame body
19: central shaft
21: end face
23: drive motor
24: drive shaft
25: tank
26: induction pipe
27: pump
28: supply pipe
29: drain pipe
30: bypass pipe
31: valve
32: valve
33: valve
35: clothes
36: periphery
37: slit
38: rear end
39: inner periphery
40: protruded part
50: control device

The invention claimed is:

1. A washing apparatus comprising:

an outer casing being disposed to contain liquid for washing;

a cylindrical basket-like washing tub being disposed in the outer casing, being disposed to contain clothing to be washed, and including a plurality of slits extending from the inner surface to an outer surface of said cylindrical basket-like washing tub;

a plurality of protruding portions being disposed on an inner surface of said cylindrical basket-like washing tub, said plurality of protruding portions protruding in a radial direction of said cylindrical basket-like washing tub and extending along an axial direction of said cylindrical basket-like washing tub;

a rotating mechanism being disposed to rotate said cylindrical basket-like washing tub about a central shaft in said outer casing;

a sensor being disposed to detect the level of said liquid in said outer casing; and a controller being disposed to start rotating said cylindrical basket-like washing tub by said rotating mechanism when said cylindrical basket-like washing tub is confirmed to be full of said liquid.

2. The washing apparatus according to claim 1, wherein said protruding portions have a wavy patterned cross section along a circumferential direction of said cylindrical basket-like washing tub.

3. The washing apparatus according to claim 1, wherein said washing tub is rotated normally and reversely with regularity for performing washing.

4. The washing apparatus according to claim 1, wherein said protruding portions are provided on the inner surface of said cylindrical basket-like washing tub at a constant interval along the circumferential direction of said cylindrical basket-like washing tub.

5. The washing apparatus according to claim 1; wherein said washing tub is rotated intermittently for performing washing.

6. The washing apparatus according to claim 1, wherein said cleaning liquid filled in said washing tub is controlled so as to be increased or decreased in pressure by a pressure change device for performing washing.

7. The washing apparatus according to claim 1, wherein a height of said protruding portions is between 3.0% and 6.0% of an inner diameter of said cylindrical basket-like washing tub.

8. The washing apparatus according to claim 1, wherein an inner diameter of said cylindrical basket-like washing tub is equal to or more than 500 mm, and said cylindrical basket-like washing tub rotates at a speed of 5 to 60 rotations per minute.

9. The washing apparatus according to claim 1, wherein an inner diameter of said cylindrical basket-like washing tub is less than 500 mm; and said cylindrical basket-like washing tub rotates at a speed of 60 to 120 rotations per minute.

10. The washing apparatus according to claim 1, wherein said slits are provided between said protruding portions along circumferential direction of said cylindrical basket-like washing tub.

* * * * *